United States Patent [19]

Klotz et al.

[11] Patent Number: 5,071,522

[45] Date of Patent: Dec. 10, 1991

[54] PROCESS FOR THE PREPARATION OF CHROMIC ACID

[75] Inventors: Helmut Klotz, Bergisch Gladbach; Hans D. Pinter, Pulheim; Rainer Weber, Leverkusen; Hans-Dieter Block, Leverkusen; Norbert Lönhoff, Leverkusen, all of Fed. Rep. of Germany

[73] Assignee: Bayer Aktiengesellschaft, Leverkusen, Fed. Rep. of Germany

[21] Appl. No.: 663,031

[22] Filed: Feb. 25, 1991

Related U.S. Application Data

[63] Continuation of Ser. No. 393,446, Aug. 14, 1989, abandoned.

[30] Foreign Application Priority Data

Aug. 27, 1988 [DE] Fed. Rep. of Germany ..... 3829125

[51] Int. Cl.[5] ..... C25B 1/22

[52] U.S. Cl. ..... 204/59 R; 204/97

[56] References Cited

U.S. PATENT DOCUMENTS 2,099,658 11/1937 Pearson et al. ..... 204/89

FOREIGN PATENT DOCUMENTS 0739447 7/1966 Canada ..... 204/97

739447 7/1966 Canada ..... 204/97

OTHER PUBLICATIONS

Ullmann's Encyclopedia of Industrial Chemistry, Fifth, Completely Revised Ed., vol. A7: Chlorophenols to Copper Compounds.

*Primary Examiner*—John Niebling

*Assistant Examiner*—Kathryn Gorgos

*Attorney, Agent, or Firm*—Sprung Horn Kramer & Woods

[57] ABSTRACT

A process for the preparation of chromic acid by the electrolysis of dichromate and/or monochromate solutions in electrolytic cells in which the anode chamber and the cathode chamber are separated by a cation exchanger membrane, the improvement wherein the chromic acid content of the solution in the anode chamber is periodically increased above that of a continuous operating state.

4 Claims, No Drawings

PROCESS FOR THE PREPARATION OF CHROMIC ACID

This application is a continuation, of application Ser. No. 393,446, filed Aug. 14, 1989 now abandoned.

BACKGROUND OF THE INVENTION

1. Field of the Invention

This invention relates to a process for the preparation of chromic acid by the electrolysis of solutions of dichromates and/or monochromates in electrolytic cells in which the anode chamber and cathode chamber are separated by cation exchanger membranes.

2. Description of Related Art

According to CA-A-739 447, the electrolytic preparation of chromic acid ($CrO_3$) is carried out in an electrolytic cell in which the electrode chambers are separated by a cation exchanger membrane. A solution of an alkali metal dichromate, generally sodium dichromate, or of an alkali metal monochromate or of a mixture of alkali metal dichromate and alkali metal monochromate is introduced into the anode chamber and converted into a solution containing chromic acid by selective transfer of the alkali metal ions into the cathode chamber through the membrane. The concentration of chromic acid and of alkali metal ions in the solution leaving the anode chamber may be adjusted to various values by varying the quantity of alkali metal dichromate introduced into the anode chamber of the cell and the current intensity. The electrolysis is generally operated under such conditions that constant ratios of chromic acid to alkali metal ions are established in continuous operation.

For the production of chromic acid crystals, the solutions formed in the anode chamber of the cell are concentrated by evaporation so that crystallization takes place at, for example, 60° to 100° C. The crystallized chromic acid is then separated, washed and dried.

This process is accompanied by the formation of deposits of compounds of polyvalent ions, in particular of alkaline earth metal compounds, which impair the function of the membrane within a short time until the membrane completely fails. The formation of these deposits is due to the presence of small quantities of polyvalent cations, in particular calcium and strontium ions, in the alkali metal dichromate solutions used as electrolytes, of the kind obtained from the industrial processes described in Ullmann's Encyclopedia of Industrial Chemistry, 5th Edition, Volume A 7, 1986, pages 67 to 97.

It was an object of the present invention to provide a process for the preparation of chromic acid by electrolysis which would be free from the disadvantages described above.

It has surprisingly been found that the aforesaid disadvantages do not occur if the chromic acid content of the solution in the anode chamber of the cell is periodically raised above that of a continuous operating state.

This invention relates to a process for the preparation of chromic acid by the electrolysis of dichromate and/or monochromate solutions in electrolytic cells in which the anode chamber and the cathode chamber are separated by a cation exchanger membrane, characterised in that the chromic acid content of the solution in the anode chamber is periodically increased above that of a continuous operating state.

This increase is preferably brought about by lowering of the rate of throughput of the dichromate and/or monochromate solution through the anode chamber of the cell but may also be brought about by increasing the current intensity up to 3–4 $KA/m^2$ and/or by an external supply of chromic acid or of chromic acid solution.

In the process according to the invention, the periodic increase in the chromic acid concentration is preferably brought about after 1 to 100 days electrolysis. The point in time chosen for carrying out this measure depends on the concentration of polyvalent cations present in the dichromate and/or monochromate solution. If these cations are present at very low concentrations, the measure may be carried out after more than 100 days. The process according to the invention prevents the formation of deposits and dissolves any deposits already formed so that the service life of the membrane is considerably increased, thereby ensuring prolonged and continuous maintenance of the electrolytic process.

The electrolytic cells used in the examples consisted of anode chambers of pure titanium and cathode chambers of refined steel. Cation exchanger membranes manufactured by DuPont under the name Nafion® 324 were used as the membranes. The cathodes consisted of refined steel and the anodes of a titanium expanded metal with an electrocatalytically active layer of tantalum oxide and iridium oxide. Such anodes are for example described in U.S. Pat. No. 3,878,083. The distance between the electrodes and the membrane was in all cases 1,5 mm. Sodium dichromate solutions with a content of 800 g/l of $Na_2Cr_2O_7 \bullet 2H_2O$ and with the contents of impurities indicated in the individual examples were introduced into the anode chambers.

Water was introduced into the cathode chambers at such a rate that a 20% sodium hydroxide solution left the cells. The temperature of electrolysis was in all cases 80° C., and the current density was 3 $KA/m^2$ of the projected area of the anode and cathode facing the membrane, this area being 11.4 cm . 6.7 cm.

EXAMPLE 1 (COMPARISON)

The sodium dichromate solutions used in this test had the following contents of alkaline earth ions:

calcium: 196 to 197 ppm strontium: less than 0.5 ppm magnesium: less than 0.5 to 1.1 ppm These solutions were converted electrolytically into chromic-acid-containing solutions in the above-described electrolytic cell. The sodium dichromate solutions were introduced at such a rate that a molar ratio of sodium ions to chromium (VI) of about 0.8 was formed in the anolyte leaving the cell. During the test, the cell voltage increased rapidly from an initial 4.7 V to 6.2 V and was 7.0 V after 18 days. The average current efficiency during this period was about 68%. On the 25th day, the cell voltage dropped to 3.8 V and the current efficiency to about 46%, which indicated that the functioning of the membrane had deteriorated considerably. At the end of the test, after 29 days, the membrane was completely permeated with white deposits which mainly consisted of calcium hydroxide. In addition, the membrane had bubbles about 3 to 5 mm in size in several places, same of which had burst. The membrane was, thus, no longer usable.

EXAMPLE 2 (ACCORDING TO THE INVENTION)

In this test, sodium dichromate solutions with the following contents of alkaline earth ions were employed:

calcium: 196–201 ppm
strontium: less than 0.5 ppm
magnesium: less than 0.5 ppm

These solutions were converted into chromic-acid-containing solutions in the above-described electrolytic cell, the sodium dichromate solutions being introduced at such a rate that alternating molar ratios of sodium ions to chromium (VI) of 0.8 and 0.4 were formed in the anolytes. This was achieved by operating the electrolytic cells in such a manner that for 4 days at a time molar ratios of sodium ions to chromium (VI) of 0.8 were formed in the anolyte and for 3 days at a time molar ratios of 0.4 were formed in the anolyte.

In the course of the test, the cell voltage increased from an initial 4.2 V to 5.2 V within 52 days. The average current efficiency was 40% over this period. On the 54th day, the voltage dropped to 3.9 V, and the average current efficiency to 30%, which, as explained in Example 1, indicated a disturbance in the functioning of the membrane.

At the end of the test, after 64 days, the membrane displayed bubbles in the same way as the membrane of Example 1 and was permeated with white deposits. By using the process according, to the invention, the life of the membrane had, however, been considerably prolonged under the selected conditions with high calcium contents in the electrolyte.

What is claimed is:

1. In a process for the preparation of chromic acid by the electrolysis of dichromate solutions, monochromate solutions, or a mixture of dichromate and monochromate solutions in an electrolytic cell having an anode chamber and a cathode chamber, which are separated by a cation exchanger membrane, wherein dichromate solutions, monochromate solutions, or a mixture of dichromate and monochromate solutions are introduced into and throughput through the anode chamber and wherein a content of chromic acid is formed in a solution in the anode chamber, wherein the improvement comprises periodically increasing the chromic acid content of the solution in the anode chamber above that of a continuous operating state of the cell and thereby dissolving deposits of polyvalent cation impurities in the membrane.

2. Process according to claim 1, wherein the periodic increase is carried out after a period of electrolysis of from 1 to 100 days.

3. In a process for the preparation of chromic acid by the electrolysis of dichromate solutions, monochromate solutions, or a mixture of dichromate and monochromate solutions in an electrolytic cell having an anode chamber and a cathode chamber, which are separated by a cation exchanger membrane, wherein dichromate solutions, monochromate solutions, or a mixture of dichromate and monochromate solutions are introduced into and throughput through the anode chamber and wherein a content of chromic acid is formed in a solution in the anode chamber, wherein the improvement comprises periodically increasing the chromic acid content of the solution in the anode chamber above that of a continuous operating state of the cell, the periodic increase in the chromic acid content being brought about by lowering of the throughput of the dichromate solutions, monochromate solutions, or mixture of dichromate and monochromate solutions through the anode chamber.

4. In a process for the preparation of chromic acid by the electrolysis of dichromate solutions, monochromate solutions, or a mixture of dichromate and monochromate solutions in an electrolytic cell having an anode chamber and a cathode chamber, which are separated by a cation exchanger membrane, wherein dichromate solutions, monochromate solutions, or a mixture of dichromate and monochromate solutions are introduced into and throughput through the anode chamber and wherein a content of chromic acid is formed in a solution in the anode chamber, wherein the improvement comprises periodically increasing the chromic acid content of the solution in the anode chamber above that of a continuous operating state of the cell, the periodic increase in the chromic acid content being brought about by an increase in current intensity, by an external supply of chromic acid or chromic acid solutions, or by a combination of an increase in current intensity and an external supply of chromic acid or chromic acid solutions.

* * * * *